US007451887B2

(12) United States Patent
Kobayashi et al.

(10) Patent No.: US 7,451,887 B2
(45) Date of Patent: Nov. 18, 2008

(54) PLATE EXCHANGEABLE COMPACT CONTAINER

(75) Inventors: Tsutomu Kobayashi, Osaka (JP); Chiaki Kamimura, Osaka (JP)

(73) Assignee: The Procter & Gamble Company, Cincinnati, OH (US)

( * ) Notice: Subject to any disclaimer, the term of this patent is extended or adjusted under 35 U.S.C. 154(b) by 738 days.

(21) Appl. No.: 11/064,662

(22) Filed: Feb. 24, 2005

(65) Prior Publication Data

US 2005/0205569 A1 Sep. 22, 2005

(30) Foreign Application Priority Data

Feb. 24, 2004 (JP) ..... 2004-047371

(51) Int. Cl.
*B65D 21/02* (2006.01)

(52) U.S. Cl. ..... 220/23.88; 220/528; 206/823; 132/294

(58) Field of Classification Search ..... 220/4.01, 220/23.88, 528; 206/541, 581, 823; 132/293, 132/294, 295
See application file for complete search history.

(56) References Cited

U.S. PATENT DOCUMENTS 5,373,862 A * 12/1994 Blachut ..... 132/294
5,638,839 A * 6/1997 Montoli ..... 132/295
6,386,209 B1 * 5/2002 Yuhara et al. ..... 132/294

FOREIGN PATENT DOCUMENTS

JP 08-056745 5/1996

* cited by examiner

*Primary Examiner*—Anthony D Stashick
*Assistant Examiner*—Harry A Grosso
(74) *Attorney, Agent, or Firm*—Brian M. Bolam; Vladimir Vitenberg; S. Robert Chuey

(57) ABSTRACT

A plate-exchangeable compact container having a mounting chamber which can store a large plate or a pair of small plates, and a plate spring that applies a force in a forward direction. The spring force applies a pressure to both the left and right sides of the large plate or to the small plates. When the small plates are mounted in the mounting chamber, engagement protrusions are attached in a manner which allows them to contact the side regions of each small plate back panel.

4 Claims, 5 Drawing Sheets

PLATE EXCHANGEABLE COMPACT CONTAINER

FIELD OF TECHNOLOGY

The present invention relates to a plate exchangeable compact container.

DESCRIPTION OF RELATED ART

Several plate exchangeable compact containers are commonly known, and for instance, there are containers where the container body bottom beneath a plate storage chamber is an elastically deformable pressing part, and a plate which has been mounted in the storage chamber can be pushed up and out by pressing the press part (Patent Citation 1).

Furthermore, commercial products are known where a mounting chamber which can exchange and store a large plate or a left and right pair of small plates, a plate spring which applies a force in the forward direction is established in the front surface on the left and right sides of the back wall of said mounting chamber, and when a large plate is mounted into said mounting chamber, the tips of both plate springs press against the back surface on the left and right sides of the back panel of the large plate, and when small plates are mounted, press against the center region in the left and right direction of the back surface of the back panel, such that the front panel of the plates is able to be pressed against the front wall of the mounting chamber.

Patent Citation 1 Japanese Patent Application H8-56745

DISCLOSURE OF THE INVENTION

Of the aforementioned publicly known examples, the latter compact container does not have a problem when the large plate is mounted, but when the small plates are mounted, [the small plates] readily fallout from the mounting chamber.

The present invention was established to overcome these problems so that when the left and right pair of small plates are mounted, the small plates will not inadvertently fallout, and when necessary, removal of the small plate can easily be performed.

MEANS TO RESOLVE THE PROBLEMS

The No. 1 means is a plate exchangeable compact container having a mounting chamber 7 which can store a large plate 31 and a pair of left and right small plates 41 in a condition which can be exchanged, the left and right side of the front surface of the rear wall of said mounting chamber having a plate spring 10 which applies a force in a forward direction, such that when the large plate is mounted in said mounting chamber, the tips of both plate springs 10 apply pressure to both the left and right sides of the large plate back panel 33, and when small plates 41 are mounted, apply a pressure to the middle region in the left and right direction of each small plate back panel 43 such that the front panel of each plate can be pressed against a front wall of the mounting chamber, and when the small plates are mounted in the mounting chamber, a left and right pair of engagement protrusions 11 in the middle region in the left and right direction of the front surface of said back wall 2 are attached in a manner which can contact to the side regions of each small plate back panel 43.

The No. 2 means is comprising the No. 1 means and is formed such that a No. 2 locking rib is laterally established on the left and right side outer surfaces of both of the front and back panels of said large plate and the outer surface middle region in the left and right direction of both the front and back panels of said small plates, and a No. 1 locking rib 9 is laterally established on the inside surface of the left and right sides of both the front and back walls of the mounting chamber, and when the large plate 31 is mounted, the No. 2 locking rib 34 of the large plate is able to lock to the bottom surface of said No. 1 locking rib 9 and when the small plates are mounted, the No. 2 locking rib 34 of the small plate is able to lock to the surface of said No. 1 locking rib 9.

The No. 3 means comprises the No. 1 means and the No. 2 means and the mounting chamber front wall is made lower than the front panel 32, 34 of said large and small plates, and a finger clip 46 is established for each plate on each front panel region which protrudes in the direction of the front wall.

The No. 4 means is comprising said No. 2 and No. 3 means, and said compact container is formed such that an axial support panel 22 which is suspended down from a back part of a lid body 21 is mounted into the relief concave region 3 of the top surface and back surface which have a hole formed in the back surface of the part excluding the left and right side regions of the back wall 2 of the container body, said axle support panel and concave left and right outer back wall part are pivotally attached, and the container body is formed to freely open and close by rotation of the lid body around said pivotally attached part, and a back wall region of the front part of the concave region 3 is formed from a thin elastic panel as a chamber back wall that mounts to said container body back wall 2, a plate spring 10 and a No. 1 locking rib 9 are attached to the left and right sides of said elastic panel and a left and right pair of stopping protrusions 11 are attached to the center region in the left and right direction of said elastic panel.

Effect of Invention

By forming according to Claim 1, when the small plates are mounted, the back panel 43 region of the small plates will be in contact with the plate spring 10 and the stopping protrusion 11, and therefore the small plate mounting force from the mounting chamber will be stronger than if only a plate spring was in contact and the small plate can be made more difficult to remove. Furthermore, when removing the small plates when necessary, the small plate back panel 43 will move toward the back as a support point for supporting the back panel and side regions which contact said stopping protrusion 11 because the small plate front panel 42 is pushed backward, and nearly all of the panel will become separated from the front wall of the mounting chamber, so removal can be simplified and inadvertently removal will become more difficult, and yet the small plates 41 can easily be removed by human intervention.

By forming according to Claim 2, the previously mentioned effect of Claim 1 can be made even more effective by engaging and separating both the No. 1 locking rib 9 and a No. 2 locking rib 34.

By forming according to Claim 3, the operation of mounting and unmounting in the mounting chamber can be easily performed by pressing the plate backwards and pulling upwards.

By forming according to Claim 4, when the small plates 41 are pushed backwards, the mating chamber back wall region which has stopping protrusions 11 will also elastically deform and move towards the back so that the effect shown in Claim 1 can be further increased.

DESCRIPTION OF THE PREFERRED EMBODIMENTS

The drawings will be described below. First, the conventional and publicly known section will be briefly described. Numeral 1 represents a container body, and said container body has a surrounding wall which rises up from the outer circumference of a bottom panel, and a back part of a back wall 2 which forms a part of said surrounding wall has a concave region 3 opening on both the top and bottom surfaces and on the back surface excluding the left and right ends, and furthermore, the center region in the left and right direction of the front surface of a front wall 4 has a locking part 54 locking plate which is suspended down from the front part of a lid body which will be discussed later, and a partition wall 6 is established in the center region in the front and back direction of the container body, and the region between said partition wall and said back wall is a plate mounting chamber 7, and the region between the partition wall and the front wall 4 is a cosmetic apparatus storage chamber 8.

A No. 1 locking rib 9 is laterally established on both the left and right side surfaces of the back wall 2 and of the partition wall 6 which form both the front and back walls of said plate mounting chamber 7, and a plate spring is attached on both sides, sandwiching the No. 1 locking rib of the back wall.

Numeral 21 represents a lid body, and an axial support panel 22 which mates into the aforementioned concave region 3 of the container body back wall is suspended down from the back region of said lid body, the axial support panel and the left and right sides of the back wall of the container body are pivotally attached in a manner which can rotate, and by rotating around said pivot region, lid body 21 can freely open and close the top surface of the container body. A locking panel 23 which engages the aforementioned locking part is suspended down from the front part of the lid body.

The large plate 31 shown in FIG. 1 and the left and right pair of small plates 41 are mounted in a manner which can be exchanged into the aforementioned mounting chamber. The small plates are the same shape and same size, and the left and right combination is nearly the same size as the large plate.

The No. 2 locking ribs 34 are attached to the left and right side outer surface of the front and back panels 32, 33 of the large plate, and these No. 2 locking ribs can lock to the aforementioned No. 1 locking rib 9 bottom surface. Furthermore, the No. 2 locking ribs 34 are attached to the outside surface of the center region in the left and right direction of the front and back panels 42, 43 of the small plates and can lock to the bottom surface of the No. 1 locking ribs 9 when [the small plates are] mounted in the mounting chamber.

The tip of the plate spring 10 pushes the back panels 33, 34 of the large plate 31 and the small plates 41 in the forward direction, and pushes the front panels 32, 42 toward the partition wall 6 as the front wall of the mounting chamber. In this condition, a small gap is formed between the back panels 33, 43 and the back wall 2, as shown in FIG. 1 and FIG. 2, and when the plates are pressed backwards from said mounting condition, the plates will move backwards, the locking of said front side No. 1 and No. 2 locking ribs 9, 34 will be released, and therefore, the plate can be removed by pulling up on the front panel 32, 42 of the plate.

With the present invention, a left and right pair of stopping protrusions is vertically established as shown in FIG. 1 and FIG. 2 in the front surface of the middle region in the left and right direction of the back wall 2. These stopping protrusions are established such that no contact will be made with the back panel 33 of the large plate when the large plate is mounted in the storage chamber as shown in FIG. 1, and contact will only be made with the back part of the back surface of the back panel of the adjacent small plates as shown in FIG. 2 when the small plates 41 are mounted. Said stopping protrusions 11 may also be established to contact the small plate back panel 43 through a protrusion panel part 44 attached to the back panel of the small plates as shown in FIG. 6.

As shown in FIG. 3 and FIG. 4, a protruding ridge 14 is established from both the front and back walls of the mounting chamber in the front and back center direction in the center region in the left and right direction of the bottom wall of the mounting chamber, concave regions 45 for mating with these ridges are established in the bottom surface of the small plate bottom panel, and are distinguished as being for a right mount or a left mount in the mounting chamber. The aforementioned concave region 45 for mating with the protrusion ridge is also established in the bottom surface of the bottom panel of the large plate.

The forward facing back wall section of the concave region 3 may be made from a thin elastic panel, the plate spring 10 and the No. 1 locking ribs 9 open a window 12 in the bottom part on the left and right sides of the elastic panel as shown in FIG. 5, and the plate springs 10 may be formed to rise from the left and right sides of the bottom edge of said window, and the elastic panel 13 which has the No. 1 locking ribs 9 attached may be formed to rise from the center region between these plate springs.

The front wall of the mounting chamber leaves both sides in the left and right direction as shown in FIG. 2 and FIG. 6, and the center region between the sides is formed to be lower than the height of the front panel of the plate, and the front panel part of the big plate that protrudes upward higher than the center part which is made to be lower forms a finger clip 46 for the plate.

With the above construction, when the big plate 31 is mounted in the mounting chamber as shown in FIG. 1, the No. 2 locking ribs 34 which are attached to the left and right outside surfaces of the front and back panels of the large plate will lock with the bottom surface of the No. 1 locking ribs 9 attached to the left and right inside surfaces of the front and back walls of the mounting chamber and the plate springs 10 which are established in the left and right sides of the back wall 2 will push the back surface of the back panel 33 of the large plate and will push the front panel 32 of the large plate toward the partition wall 6 as the front wall of the mounting chamber, and the left and right pair of stopping protrusions which are attached to the center region in the left and right direction of the rear wall will be separated from the back panel 33 of the large plate by a gap.

Therefore, when the large plate is mounted as shown in FIG. 1, the mounting of the large plate will be maintained by the force pressing on the large plate by the plate springs at the left and right region of the back wall and by the locking at the four front, back, left, and right regions by the No. 1 and No. 2 locking protrusions similar to the conventional case, and mounting and unmounting of the large plate will be performed similar to the conventional manner.

When the small plates are mounted as shown in FIG. 2, the left and right pair of small plates will be locked to the front and back of the center region in the left and right direction by the locking of said No. 1 and No. 2 locking protrusions, and the plate springs 10 on the left and right regions of the rear wall 2 will press the center region in the left and right direction of the rear panels of both small plates so that the small plate mating condition will be maintained, and [the small plates] will be held to the back surface of the back panel edge on the side adjacent to the small plates by the contact with said stopping protrusions 11, and the stopping protrusions 11 contacting the rear surface of the rear panel end side of the side adjacent to the small plates is the point that differs from the conventional case.

When the small plate front panel 42 is pushed to the back from said mounting condition, the locking of the No. 1 and No. 2 locking ribs 9, 34 on the mounting chamber front wall side will be disengaged, so the small plates 41 can be removed by pulling up on the front panel in this condition, and when mounting the small plates, the back part of the small plate is first placed in the mounting chamber, and the small plate front part is pressed downward while the small plates are pushed backwards.

Note, as shown in FIG. 2, when the small plates are mounted, it is preferable for a small gap to also be formed between the outward side panel of the small plates and the side wall 15 of the mounting chamber, and by so doing, the small plates can easily be mounted and unmounted.

DESCRIPTION OF FLAGS

Figure 1:
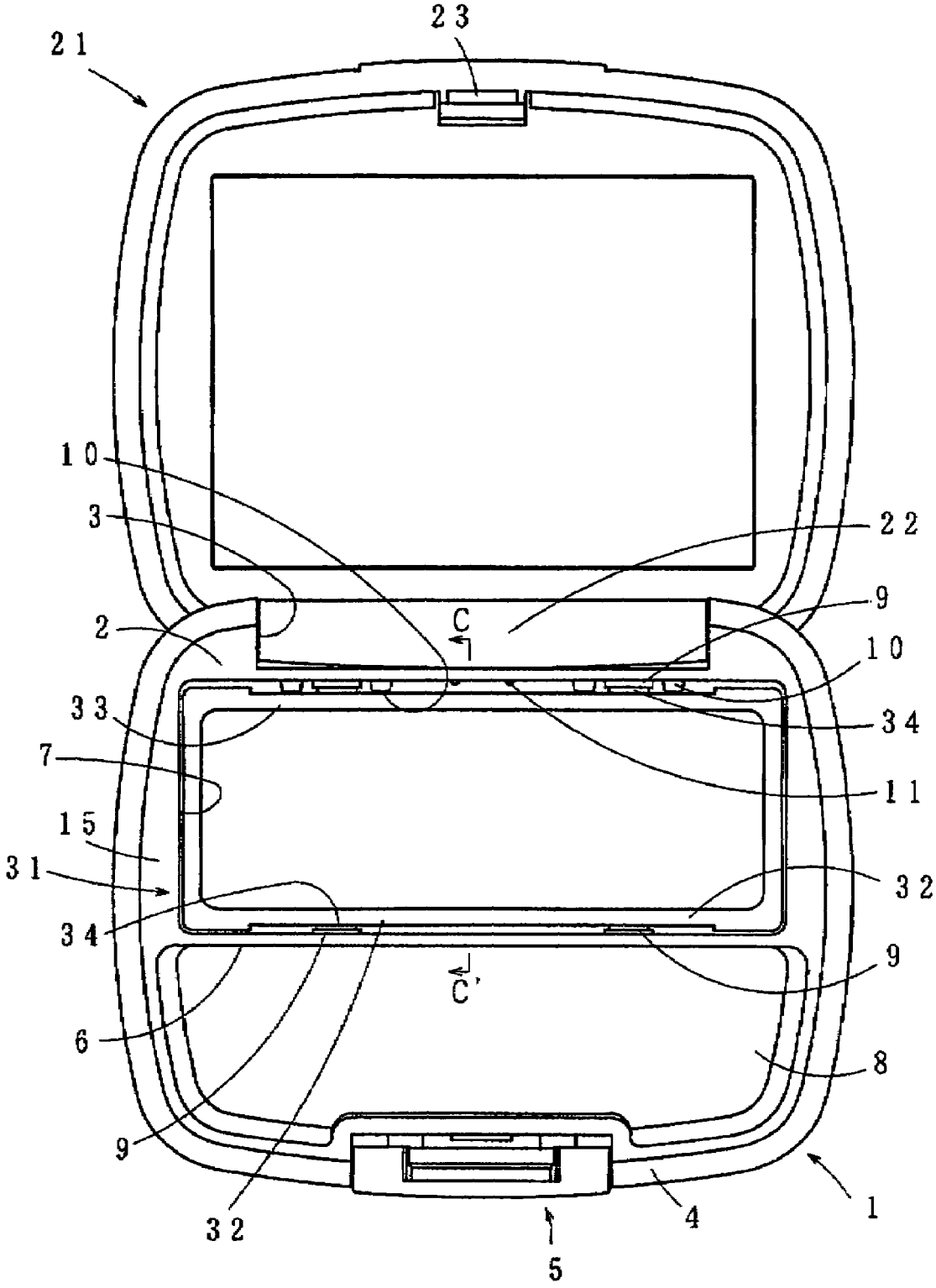
FIG. 1 is a plain view of the container of the present invention showing the lid open and the large plate mounted.
Figure 2:
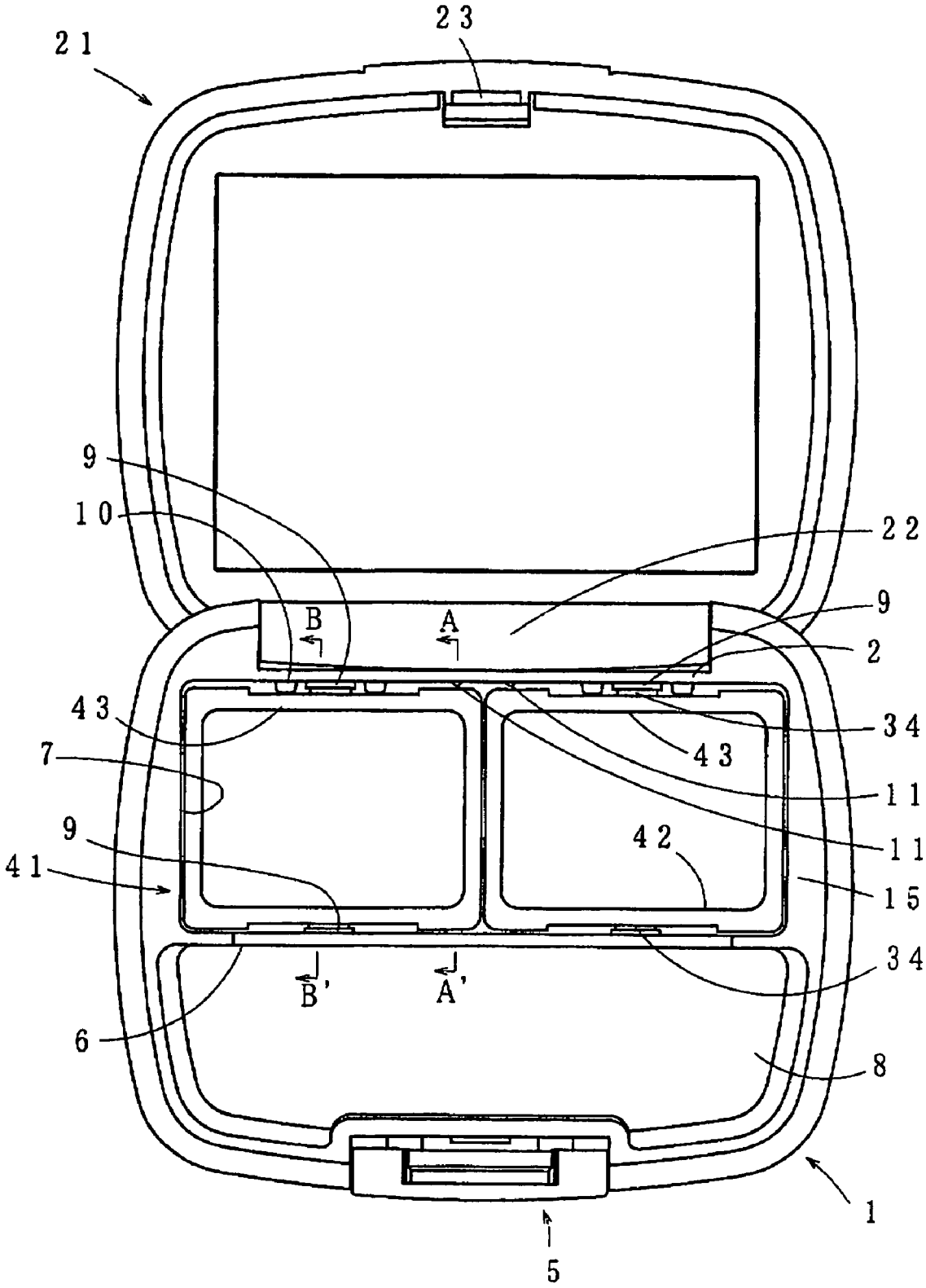
FIG. 2 is a plain view of the container of FIG. 1 showing the lid open and the small plates mounted.
Figure 3:
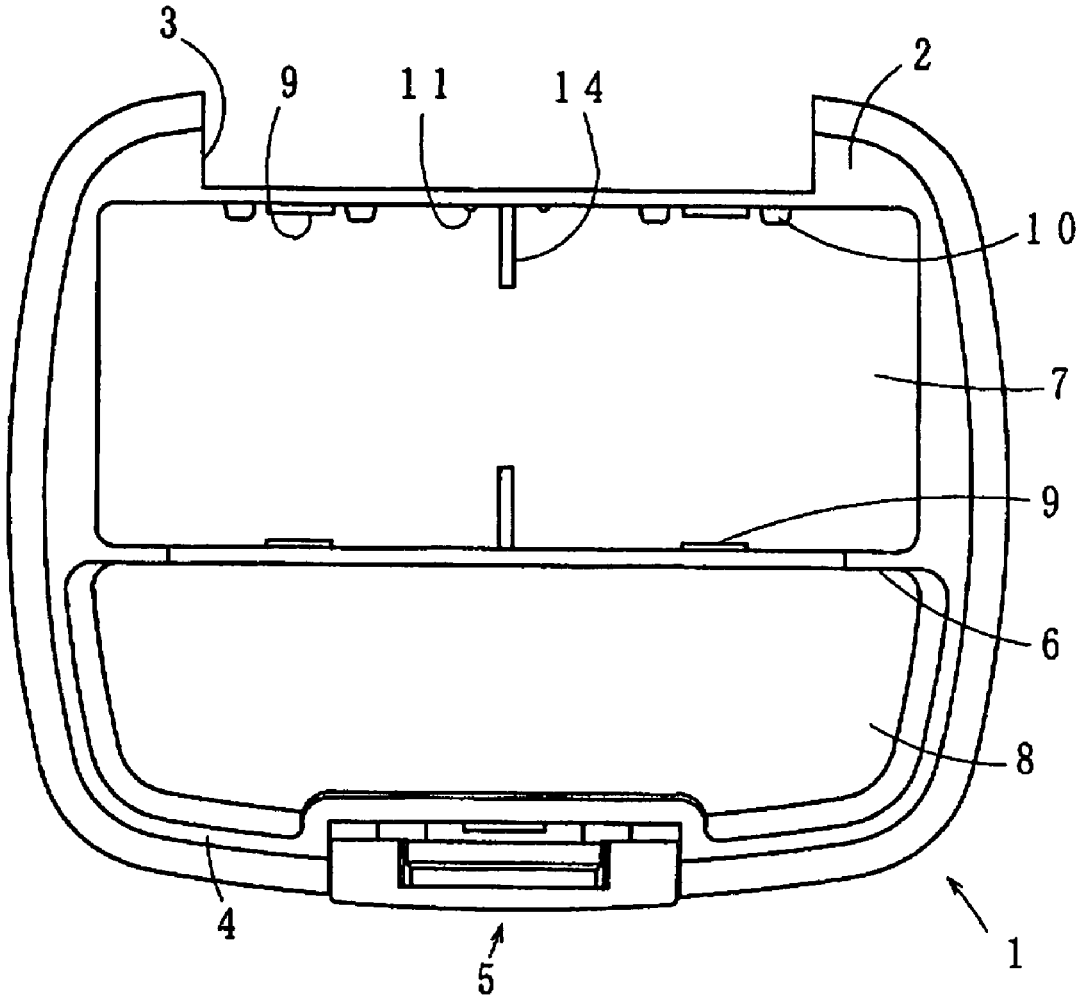
FIG. 3 is a plain view of the container body of FIG. 1.
Figure 4:
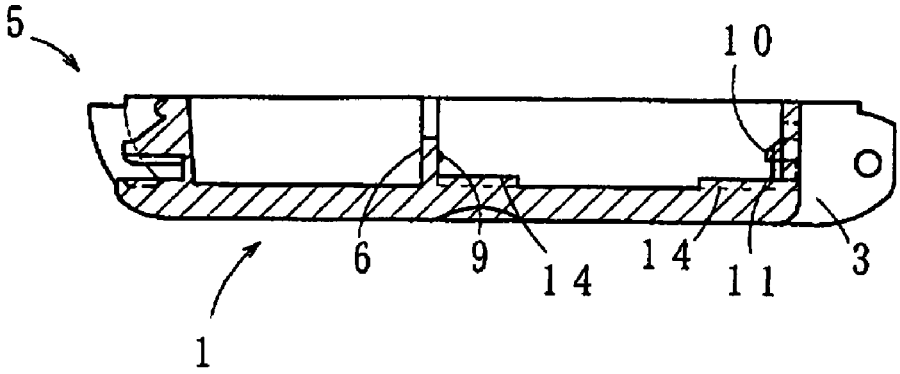
FIG. 4 is a cross-section view of the container body of FIG. 3 cut along the front and back direction.
Figure 5:
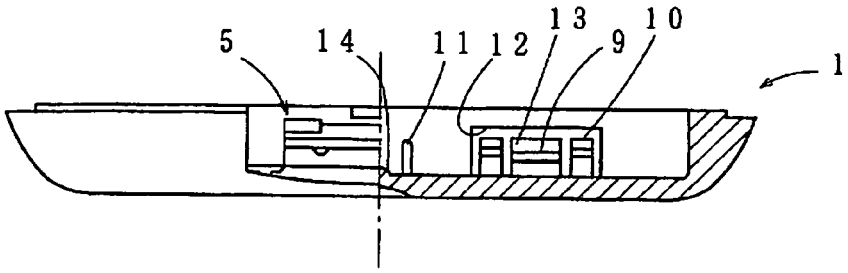
FIG. 5 is a cross-section view showing the container body of FIG. 3 cut along the left and right direction.
Figure 6:
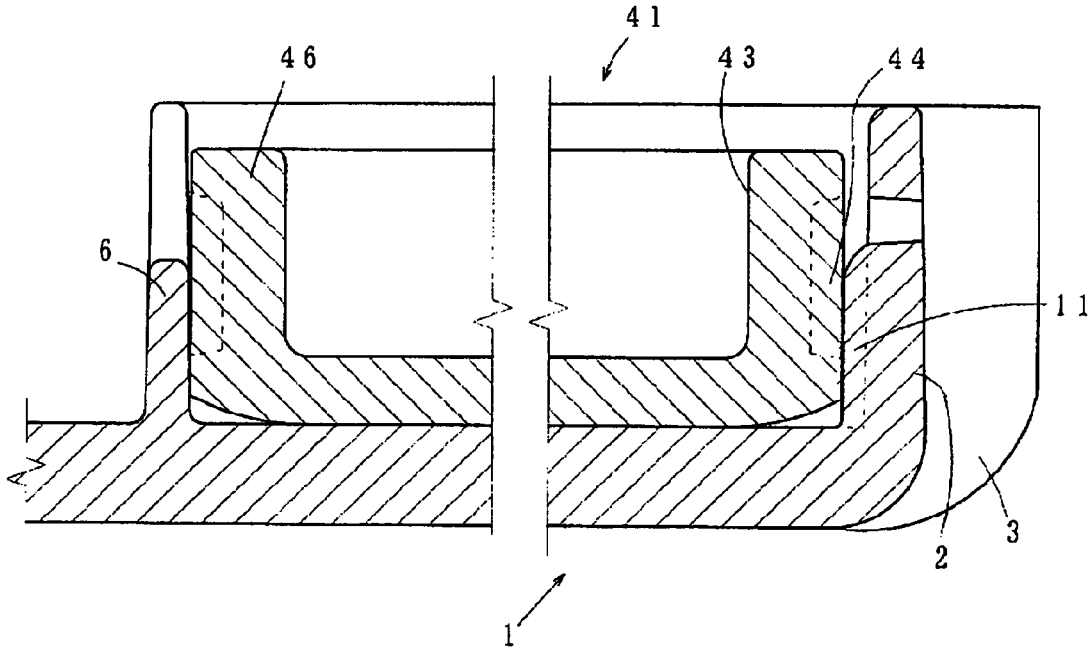
FIG. 6 is an expanded cross-section view looking from the direction of the arrow of line A-A' of FIG. 2 showing the conditions where the small plates are engaged into the mounting chamber of the container body.
Figure 7:
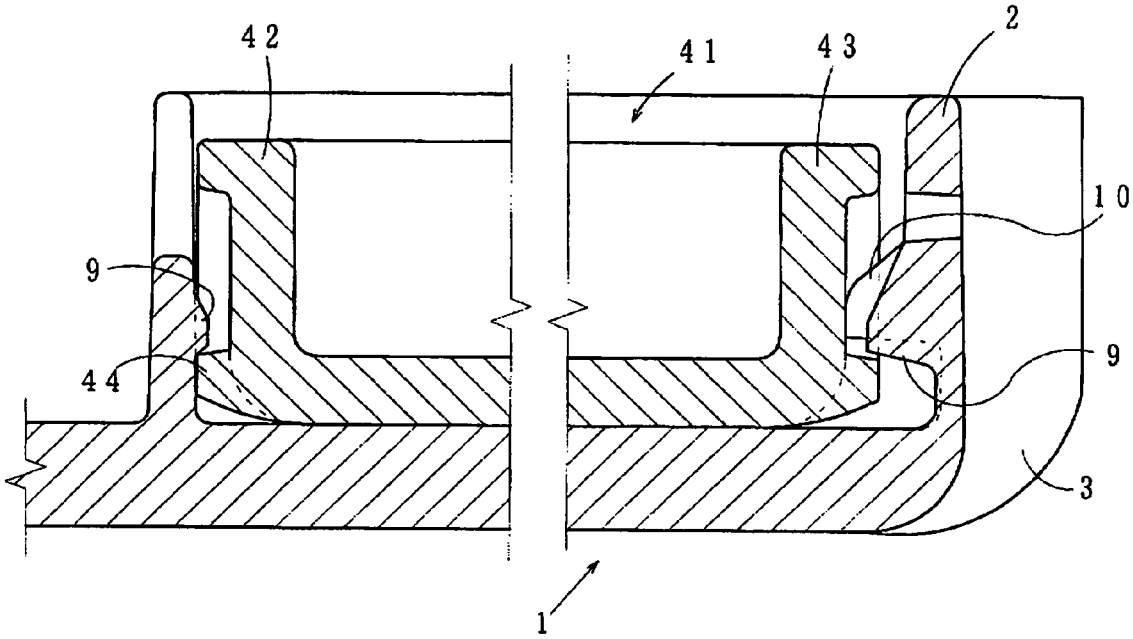
FIG. 7 is an expanded cross-section view looking from the arrow direction of the B-B' line of FIG. 2.
Figure 8:
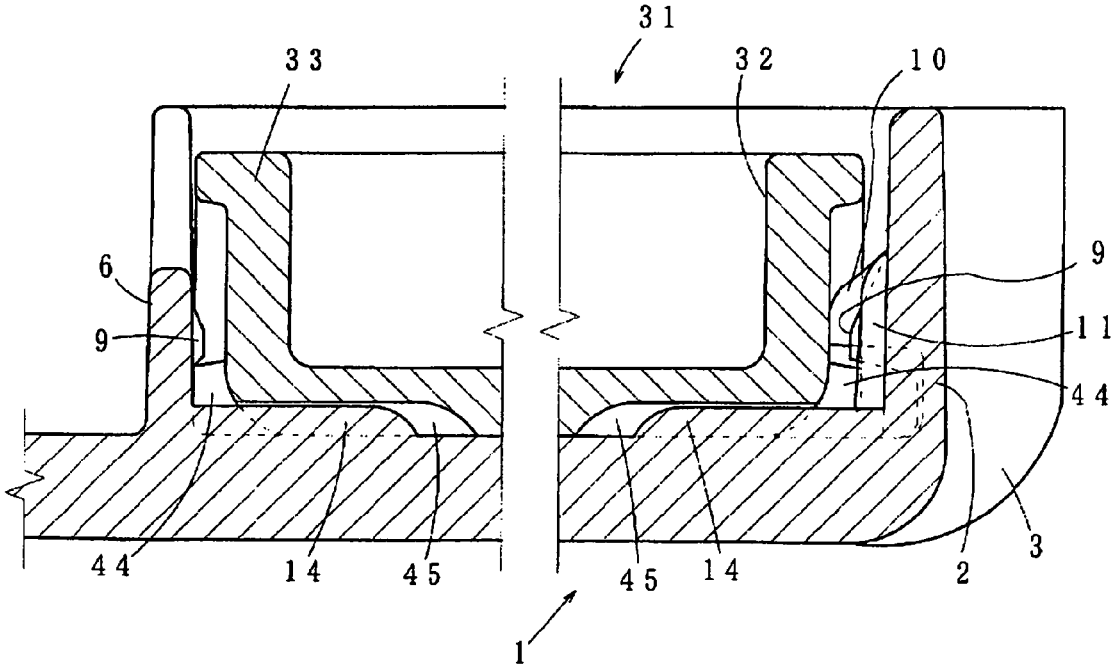
FIG. 8 is an expanded cross-section view looking from the arrow direction of the line C-C' of FIG. 1.

1 CONTAINER BODY
2 BACK WALL
3 CONCAVE REGION
6 PARTITION WALL (MOUNTING CHAMBER FRONT WALL)
7 MOUNTING CHAMBER
9 NO. 1 LOCKING RIB
10 PLATE SPRING
11 STOPPING PROTRUSION
21 LID BODY
31 LARGE PLATE
32 FRONT PANEL
33 BACK PANEL
34 NO. 2 LOCK RIB
41 SMALL PLATE
42 FRONT PANEL
43 BACK PANEL

What is claimed is:

1. A plate exchangeable compact container having a mounting chamber which can store a large plate or a pair of left and right small plates in a condition which can be exchanged, the left and right end of the front surface of the rear wall of said mounting chamber having a plate spring which applies a force in a forward direction, such that when the large plate is mounted in said mounting chamber, the tips of both plate springs apply a pressure to both the left and right sides of the large plate back panel, and when small plates are mounted, applies a pressure to the middle region in the left and right direction of each small plate back panel such that the front panel of each plate can be pressed against a front wall of the mounting chamber, characterized in that when the small plates are mounted in the mounting chamber, a left and right pair of engagement protrusions in the middle region of the left and right direction of a front surface of a back wall are attached in a manner which can contact to the side regions of each small plate back panel.

2. The plate exchangeable compact container according to claim 1 formed such that a No. 2 locking rib is laterally established on the left and right side of the outer surface of both of the front and back panel of said large plate and the outer surface middle region in the left and right direction of both the front and back panels of said small plates, and a No. 1 locking rib is laterally established on the inside surface of the left and right sides of both the front and back walls of the mounting chamber, and when the large plate is mounted, the No. 2 locking rib of the large plate is able to engage with the bottom surface of said No. 1 locking rib and when the small plates are mounted, the No. 2 locking rib of the small plates is able to lock to the surface of said No. 1 locking rib.

3. The plate exchangeable compact container according to claim 1 wherein the mounting chamber front wall is made lower than the front panels of said large and small plates, and a finger clip is established for each plate on each front panel region which protrudes in the direction of the front wall.

4. The plate exchangeable compact container according to claim 2 wherein said compact container is formed such that an axial support panel which is suspended down from a back part of a lid body mates into the relief concave region of the top surface and back surface which have a hole formed in the back surface of the part excluding the left and right side regions of the back wall of the container body, said axle support panel and concave left and right outer back wall part are pivotally attached, and the container body is formed to freely open and close by rotation of the lid body around said pivotally attached part, and a back wall region of the front part of the concave region is formed from a thin elastic panel as a chamber back wall that mounts to said container body back wall, a plate spring and a No. 1 locking rib are attached to the left and right sides of said elastic panel and a left and right pair of stopping protrusions are attached to the center region in the left and right direction of said elastic panel.

* * * * *